US007543563B2

(12) United States Patent
Dunn

(10) Patent No.: US 7,543,563 B2
(45) Date of Patent: Jun. 9, 2009

(54) HIGH FLOW DUAL THROTTLE BODY FOR SMALL DISPLACEMENT ENGINES

(75) Inventor: Michael Dunn, Raymond, OH (US)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 11/690,345

(22) Filed: Mar. 23, 2007

(65) Prior Publication Data

US 2008/0230034 A1 Sep. 25, 2008

(51) Int. Cl.
*F02D 9/08* (2006.01)
*F02D 11/10* (2006.01)

(52) U.S. Cl. ..... 123/399; 123/336

(58) Field of Classification Search ..... 123/336–337, 123/400, 442, 302, 308, 399
See application file for complete search history.

(56) References Cited

U.S. PATENT DOCUMENTS 4,073,278 A * 2/1978 Glenn ..... 123/198 F
4,411,231 A 10/1983 Watanabe et al.
4,494,504 A * 1/1985 Yagi et al. ..... 123/308
4,850,319 A 7/1989 Imoehl
4,870,990 A 10/1989 Bierling et al.
5,036,816 A 8/1991 Mann
5,190,007 A 3/1993 Joyce
5,394,846 A 3/1995 Jaeger et al.
5,429,087 A * 7/1995 Tsujino et al. ..... 123/336
5,553,579 A * 9/1996 Yoshida et al. ..... 123/295
5,606,949 A * 3/1997 Ohara et al. ..... 123/396
5,845,677 A * 12/1998 Kim ..... 137/595
5,875,762 A 3/1999 Tsuchiya et al.
6,347,787 B1 * 2/2002 Tobinai et al. ..... 261/23.3
6,354,251 B1 * 3/2002 Toda ..... 123/73 A
6,484,696 B2 * 11/2002 Barnes et al. ..... 123/446
6,591,794 B2 * 7/2003 Toda ..... 123/73 A
6,769,396 B2 * 8/2004 Geyer et al. ..... 123/336
6,823,838 B2 * 11/2004 Koch et al. ..... 123/336
6,895,927 B2 * 5/2005 Fuwa ..... 123/336
6,945,231 B2 * 9/2005 Iida ..... 123/442
7,021,264 B2 4/2006 Giffin
7,025,040 B2 4/2006 Hoshino et al.
7,043,351 B2 * 5/2006 Grossmann et al. ..... 701/103
7,066,142 B2 * 6/2006 Hanasato ..... 123/336

(Continued)

FOREIGN PATENT DOCUMENTS

JP 2000-204970 7/2000

*Primary Examiner*—Hai H Huynh
(74) *Attorney, Agent, or Firm*—Mark E. Duell; Fay Sharpe LLP

(57) ABSTRACT

A throttle body for an internal combustion engine of an automobile includes a housing defining a plurality of spaced apart, separated intake passages, a plurality of throttle valves, a plurality of throttle shafts and a drive mechanism. The plurality of throttle valves is rotatably disposed in the plurality of intake passages. Each throttle shaft is adapted to support one of the plurality of throttle valves. A drive mechanism is operably connected to the plurality of throttle shafts to rotate the plurality of throttle valves. The drive mechanism includes a single motor and a gear arrangement. The gear arrangement is configured to drive at least two throttle shafts of the plurality of throttle shafts at varying speeds. The gear arrangement selectively and sequentially opens at least two throttle valves of the plurality of throttle valves at varying rates.

20 Claims, 5 Drawing Sheets

U.S. PATENT DOCUMENTS 7,104,253 B1 * 9/2006 Dow et al. ..... 123/342
7,320,305 B2 * 1/2008 Alberghini et al. ..... 123/336
7,331,326 B2 * 2/2008 Arai et al. ..... 123/361
7,334,565 B2 * 2/2008 Hanasato ..... 123/336
2005/0166892 A1 8/2005 Rauch et al.
2006/0042589 A1 3/2006 Hanasato

* cited by examiner

HIGH FLOW DUAL THROTTLE BODY FOR SMALL DISPLACEMENT ENGINES

BACKGROUND

The present disclose generally relates to an air intake control device for a motor vehicle. More particularly, the present disclosure relates to a high flow dual bore throttle body for an internal combustion engine.

Internal combustion engines require a precise mixture of air and gasoline in order to run properly. Throttle bodies are designed to regulate and adjustably control airflow into the cylinders of the engine. Electronic-controlled throttle bodies are well known for throttle control. In order to control airflow that reaches the cylinders, the throttle body generally includes a rotatably disposed throttle valve or throttle plate. The throttle plate is attached to a throttle shaft and configured such that the throttle plate is located within an intake passage or throttle bore, or proximal to an end of the throttle bore. With rotation of the shaft, the throttle plate is able to selectively regulate the area of the throttle bore, thereby selectively obstructing airflow through the throttle bore. More specifically, the throttle plate is able to rotate with respect to the bore in order to adjust the cross-sectional area of the bore that is not obstructed by the throttle plate (the "effective area"), thus controlling airflow that is permitted to flow through the throttle bore.

In order to control the effective area of the intake passage, the throttle plate is sized and shaped approximately the same as the cross-section of the bore to be able to completely or substantially obstruct the bore when the throttle plate is substantially perpendicular to the airflow (the "closed position"). Additionally, the throttle plate has a minimal thickness in order to not substantially obstruct airflow through the throttle bore when the plate is angled such that the throttle plate face is not substantially perpendicular to the airflow (the "open position").

During operation, when the engine is idling, the throttle plate is in the closed position because very little air is needed to mix with the small amount of fuel being injected into the engine. For throttle bodies having no bypass, the throttle plate generally has an initial set angle for idle speed control. Conversely, the throttle plate is in a variety of open positions at operating speeds higher than idle because more air is needed to mix with the increased amount of fuel being provided to the engine.

As the power output of small displacement engines continues to increase, a key design parameter is the flow rate of intake air to the engine. The quantity of intake air to the engine is generally limited by the size of the throttle body. To increase airflow, a large bore with a large single throttle plate can be implemented. However, due to the small displacement of the engine, idle speed control becomes a concern. This is because even a small throttle angle produces a large flow rate of intake air when a large single throttle plate is used.

Accordingly, there is need for an improved throttle body for a small displacement engine which would allow the engine to have a more stable function at lower engine speeds eliminating the idle stability concerns, but would also provide an increased effective area allowing for increased airflow and the ability to increase power out of the engine.

BRIEF DESCRIPTION

In accordance with one aspect, a throttle body for an internal combustion engine of an automobile includes a housing defining a plurality of spaced apart, separated intake passages, a plurality of throttle valves, a plurality of throttle shafts and a drive mechanism. The plurality of throttle valves is rotatably disposed in the plurality of intake passages. Each throttle shaft is adapted to support one of the plurality of throttle valves. A drive mechanism is operably connected to the plurality of throttle shafts to rotate the plurality of throttle valves. The drive mechanism includes a single motor and a gear arrangement. The gear arrangement is configured to drive at least two throttle shafts of the plurality of throttle shafts at varying speeds. The gear arrangement selectively and sequentially opens at least two throttle valves of the plurality of throttle valves at varying rates.

In accordance with another aspect, a throttle body for an internal combustion engine of an automobile includes a body having a first intake passage and a separate second intake passage. A first throttle valve is moveably disposed in the first intake passage. A second throttle valve is moveably disposed in the second passage. A first throttle shaft is connected to the first throttle valve. A second throttle shaft is connected to the second throttle valve. A single motor is operably connected to the first and second throttle shafts for rotating the first and second shafts and the first and second throttle valves connected thereto. A gear mechanism interconnects the single motor and the first and second throttle shafts. The gear mechanism includes a plurality of meshed gears arranged to selectively and sequentially move the first and second throttle valves. The first throttle valve moves from a first valve closed position toward a first valve open position at a faster rate than the movement of the second throttle valve from a second valve closed position toward a second valve open position.

In accordance with yet another aspect, a dual bore throttle body assembly comprises a body having a pair of side-by-side separated intake passages extending therethrough. A throttle valve is disposed in each intake passage and is movable between a closed position and an open position. The throttle valves are angularly offset from one another. A separate throttle shaft is connected to each throttle valve. The throttle shafts are spaced apart from one another. A single motor is operably connected to the throttle shafts to rotate the throttle shafts. A gear arrangement interconnects the single motor and the throttle shafts. The gear arrangement is configured to drive the throttle shafts at varying speeds which, in turn, selectively and sequentially moves each of the throttle valves between the closed position and the open position which in turn allows for both low and high flow rates of intake air into the throttle body.

DETAILED DESCRIPTION

Figure 1:
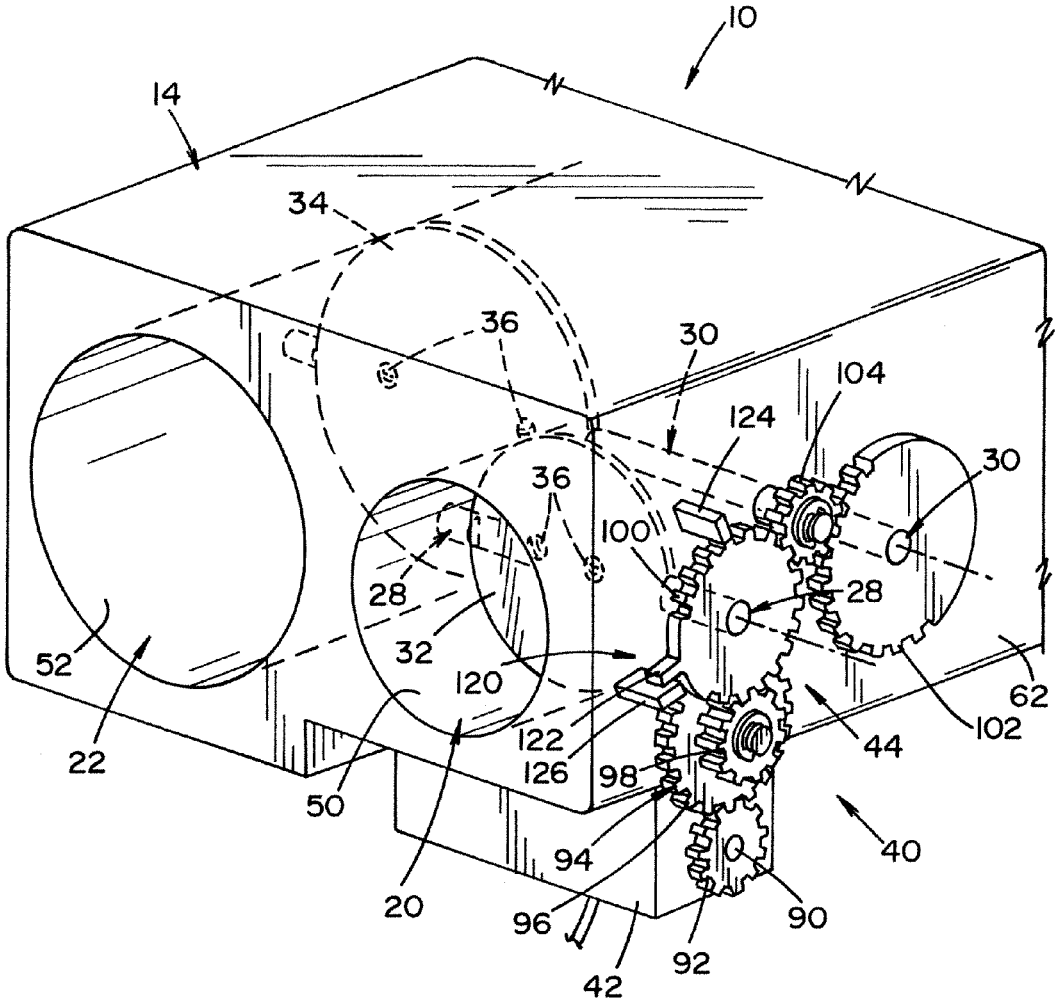
FIG. 1 is a perspective view of a throttle body for an internal combustion engine, the throttle body including separated intake passages and a drive means or mechanism according to one aspect of the present disclosure to selectively and sequentially open/close throttle valves at varying speeds.

It should, of course, be understood that the description and drawings herein are merely illustrative and that various modifications and changes can be made in the structures disclosed without departing from the scope and spirit of the present disclosure. All references to direction and position, unless otherwise indicated, refer to the orientation of the throttle body illustrated in the drawings and should not be construed as limiting the claims appended hereto. It will also be appreciated that, while the illustrated embodiments of the throttle body are particularly adapted for use with small displacement engines, it should be understood that the present disclosure can be utilized with other internal combustion engines.

Figure 2:
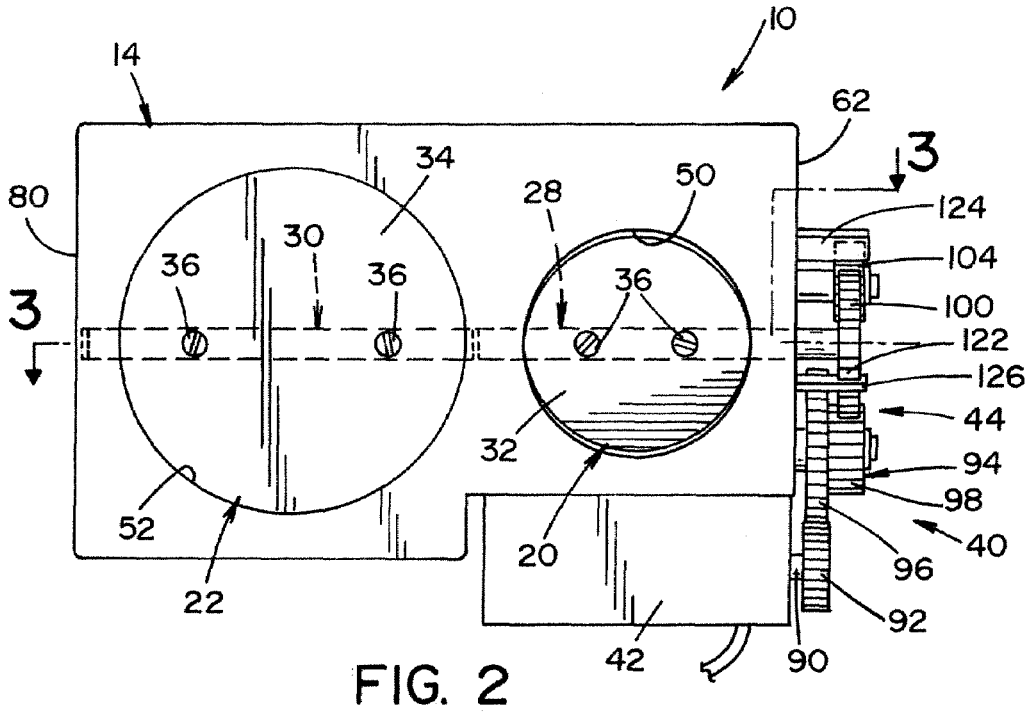
FIG. 2 is a front view of the throttle body of FIG. 1.
Figure 3:
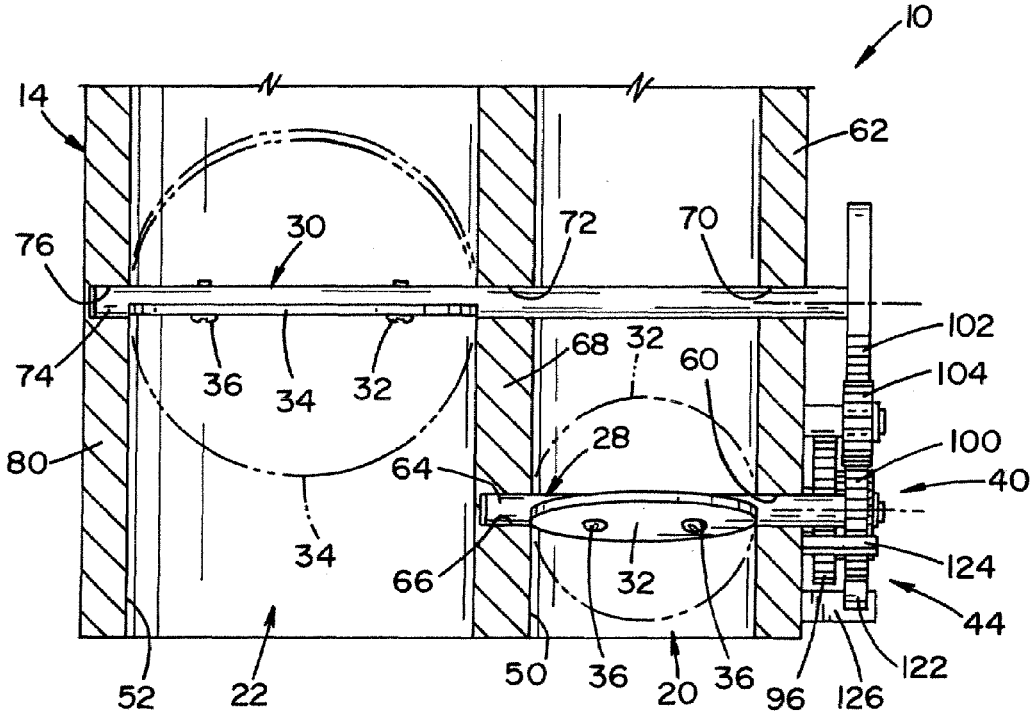
FIG. 3 is a cross-sectional view taken generally along the lines 3-3 of FIG. 2.

Referring now to the drawings, wherein like numerals refer to like parts throughout the several views, FIGS. 1-3 illustrate a dual-bore throttle body 10, according to one aspect of the present disclosure, used to control airflow into an internal combustion engine (not shown) of a motor vehicle. The dual-bore throttle body 10 is in fluid communication with combustion cylinders of the internal combustion engine and is configured to regulate and control airflow 12 (see FIGS. 4B and 5B) into the cylinders.

With particular reference to FIG. 1, the dual-bore throttle body includes a body or housing 14, typically formed of an aluminum or resin material, defining first and second spaced apart, separated bores or intake passages 20 and 22, respectively. Each intake passage can have an approximate circular cross-section. The first and second intake passages 20, 22 rotatably receive first and second throttle shafts 28 and 30, respectively, which are operable to adjust a flow rate of intake air. Each throttle shaft 28, 30 includes a longitudinal axis, the longitudinal axes of the shafts being offset from one another. The shafts 28, 30 are typically composed of steel, brass, or similar materials. First and second throttle plates or valves 32 and 34, respectively, are moveably disposed in the intake passages 20, 22. The second throttle valve 34 is downstream from the first throttle valve 32; although, this is not required. The first and second throttle valves 32, 34 are connected to the respective first and second throttle shafts 28, 30 such that the throttle valves rotate along with the shafts. The throttle valves 32, 34 can be connected to the throttle shafts 28, 30 by means of fasteners 36 (e.g., screws); although, alternative manners for securing the valves to the shafts are contemplated. In the depicted embodiment, the first and second throttle valves 32, 34 have differing diameters. Particularly, the first throttle valve 32 has a first diameter sized to regulate air flow in the first intake passage 20 having a first cross-sectional area. The second throttle valve 34 has a second larger diameter sized to regulate air flow in the second intake passage 22 having a second larger cross-sectional area. Although, it should be appreciated that the intake passages 20, 22 can have substantially equal cross-sectional areas and the throttle valves 32, 34 can have substantially equal diameters. The first and second throttle valves 32, 34 are typically constructed of brass, aluminum, resin or a similarly suitable material.

As will be further discussed below, during conditions of power demand and idle of the engine, an electronic control unit (not shown) is responsive to certain values such as an intake airflow rate, a position of an accelerator pedal (not shown), and a rotation speed and crank angle, etc. of the engine. The electronic control unit calculates fuel amounts and timings for supplying fuel to the engine based on such values to control fuel injection valves (not shown) and selectively activate a drive means or mechanism 40. The rotation of the first and second throttle shafts 28, 30 is operably controlled by the drive mechanism 40, which includes a single motor 42 and a gear arrangement or train 44. The throttle shafts 28, 30 and throttle valves 32, 34 control airflow 12 through the intake passages 20, 22 in order to achieve the optimal mix of air and fuel within the engine. As the first and second throttle shafts 28, 30 rotate, the first and second throttle valves 32, 34 likewise rotate and change the angle between the throttle valves and the first and second intake passages 20, 22.

Figure 4A:
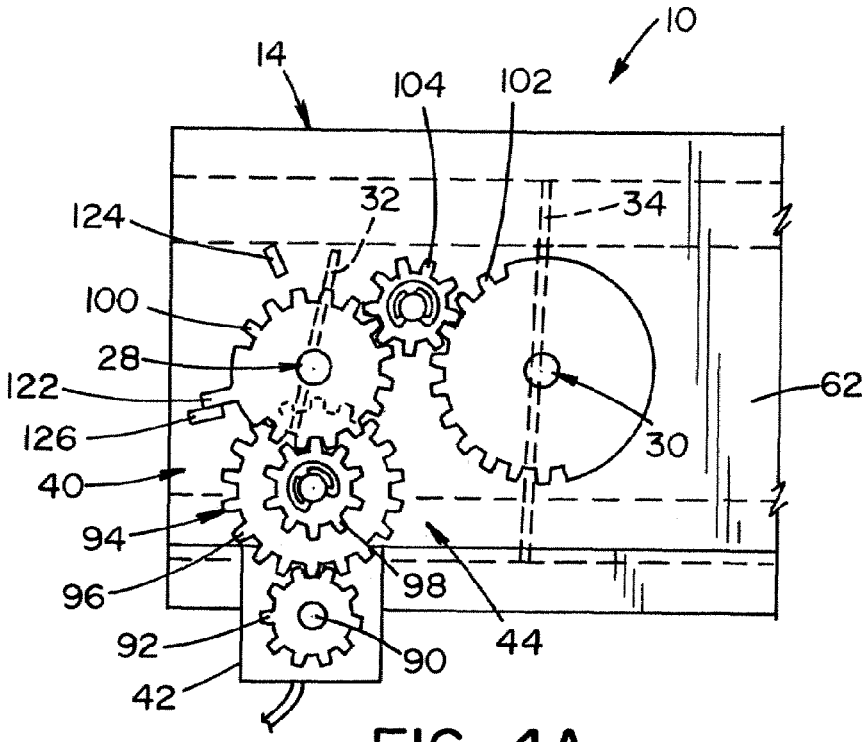
FIG. 4A is a partial side view of the throttle body of FIG. 1 illustrating the throttle valves in respective closed positions.
Figure 4B:
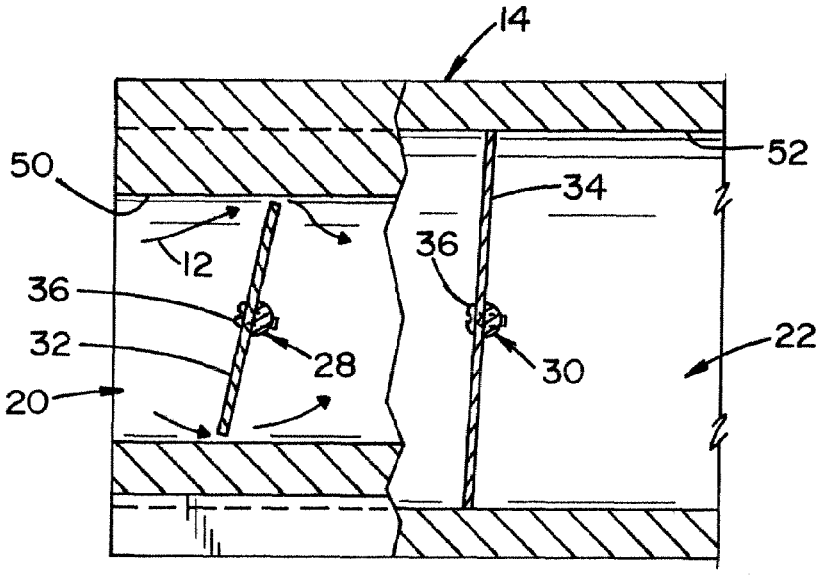
FIG. 4B is a side cross-sectional view of the throttle body of FIG. 4A.

With particular reference now to FIGS. 2 and 3, and as indicated previously, the throttle valves 32, 34 are positioned and shaped such that the circumference of each throttle valve approximates the inner surface or profile 50, 52 of each intake passages 20, 22. More specifically, in respective closed positions (i.e., when both throttle valve 32, 34 are closed, the throttle body 10 can be referred to as being in a closed state), the throttle valves 32, 34 completely or substantially block airflow through the intake passages 20, 22, by being disposed generally or mostly perpendicular relative to the direction of air flow through the intake passages. As will be understood and appreciated by those skilled in the art, the closed state of the throttle body 10 can be a state wherein one or both of the throttle valves 32, 34 are only nearly completely closed so as to permit a minimal amount of airflow to pass thereby (as might be needed for engine idling). More particularly, as shown in FIGS. 4A and 4B, the two throttle valves can be angularly offset from one another, particularly when the throttle body 10 is in a closed state. This allows a minimum flow rate required in any condition at engine idle.

Figure 5A:
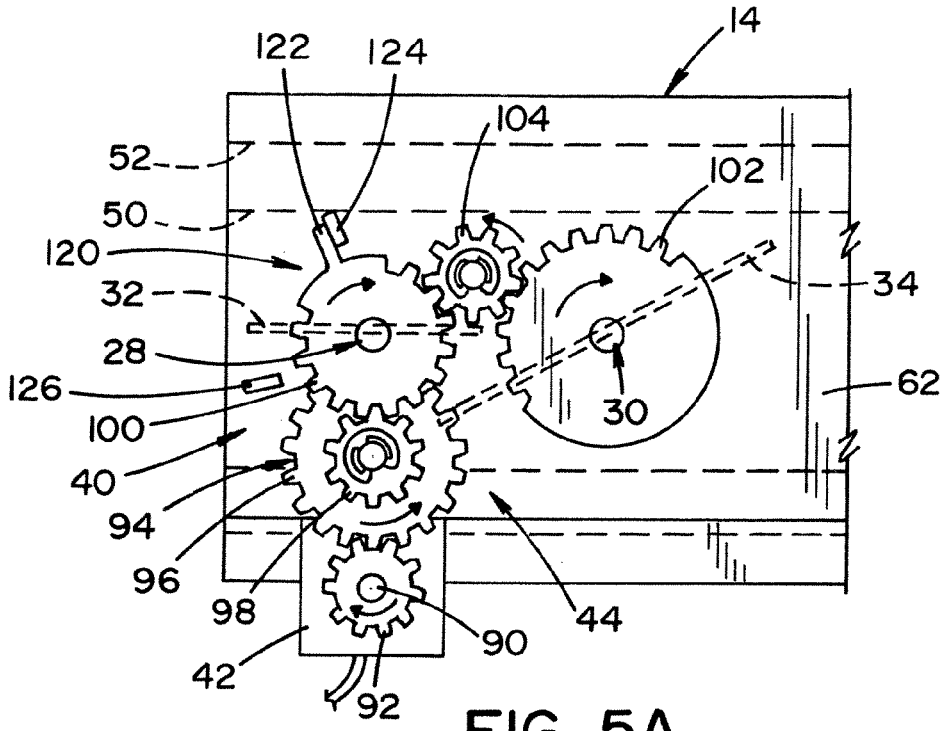
FIG. 5A is a partial side view of the throttle body of FIG. 1 illustrating the throttle valves in respective open positions.
Figure 5B:
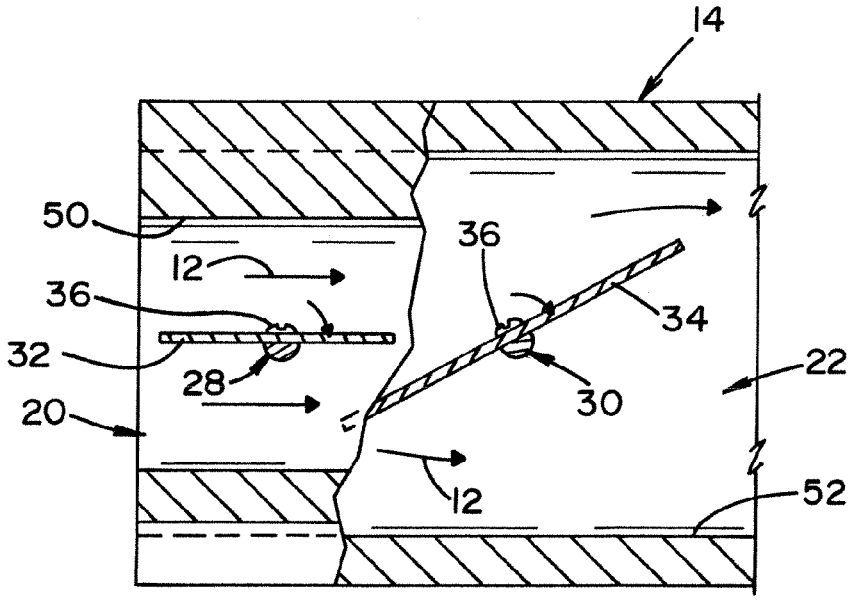
FIG. 5B is a side cross-sectional view of the throttle body of FIG. 5A.

In the closed state, illustrated in FIGS. 4A and 4B, the second valve 34 can be completely closed allowing no or almost no airflow through the second passage 22 and the first valve 32 can be only nearly completely closed (and thus angularly offset relative to the second valve 34) allowing a minimal amount of airflow through the first passage 20 as may be needed for idling. With reference to FIGS. 5A and 5B, as the first and second throttle shafts 28, 30 rotate, the first and second throttle valves 32, 34 move toward a fully open position which allows substantial airflow through the passages 20, 22. When the valves 32, 34 are moved away from their respective closed positions toward fully open positions, the throttle body 10 can be referred to as being in an open state. In the open state, the valves 32, 34 could be at various open positions between their closed positions and their fully opened positions. The particular open positions of the valves 32, 34 will be commanded by the electronic control unit as will be described in more detail below. As shown in the illustrated embodiment, the throttle plates 32, 34 are not substantially perpendicular to the air flow when the throttle body 10 is in the open state and, as shown, the angular offset of the throttle valves 32, 34 is insignificant and provides no measurable loss in performance, particularly as the valves approach their fully open positions (i.e., full throttle).

With continued reference to FIG. 3, each throttle shaft 28, 30 extends through a corresponding opening located in the housing 14. Particularly, the first throttle shaft 28 extends through opening 60 located in a first side wall 62 of the housing 14. A first end section 64 of the first throttle shaft 28 is rotatably received in a recess 66 located in an intake passage dividing wall 68. The second throttle shaft 30 extends through side wall opening 70 and dividing wall opening 72. A first end section 74 of the second throttle shaft 30 is rotatably received in a recess 76 located in a second side wall 80 of the housing 14. Bearings (not shown) can be provided in the housing openings 60, 70 and recesses 66, 76 to rotatably support the throttle shafts 28, 30 with respect to the housing. A bushing (not shown) comprised of a low friction material can be inserted between the second throttle shaft 30 and the dividing wall 68 of the housing 14. A flush connection between the bushing and the opening 72 minimizes leakage around the second throttle shaft and minimizes turbulent air flow.

The dual-bore throttle body 10 is preferably substantially airtight in order to precisely control airflow 12 into the internal combustion engine. More specifically, the first and second throttle shafts 28, 30, the bearings, if included, and the housing 14 form airtight seals. In order to form the seal at the side walls 62, 80, spacers (not shown) can be inserted between the side wall openings 60, 70 and the throttle shafts.

With reference to FIGS. 1 and 4A, and as indicated previously, rotation of the first and second throttle shafts 28, 30 is controlled by the drive mechanism 40, which includes the single motor 42 and the gear arrangement 44. The drive mechanism 40 is disposed generally below the first intake passage 20 in the illustrated embodiment and can be connected to the housing 14 via conventional manners. This arrangement of the drive mechanism 40 also reduces the dimension in the width direction of the throttle body 10. The single motor 42 includes a drive shaft 90 and a drive gear 92. The gear arrangement 44 interconnects the single motor 42 and the throttle shafts 28, 30 and includes a plurality of meshed gears arranged to selectively and sequentially move the first and second throttle valves 32, 34 at varying rates. The gear arrangement 44 generally comprises a deceleration gear 94 that integrally includes a large gear part 96 and a small gear part 98, a first drive gear 100 that is fixed to the first throttle shaft 28, a second drive gear 102 that is fixed to the second throttle shaft 30, and a connecting gear 104 disposed between the first and second drive gears. In the depicted embodiment, the first drive gear 100 is smaller in size than the second drive gear 102, which allows for rotation of the first throttle shaft 28 at a faster rate than the rate of rotation of the second throttle shaft 30. This, in turn, rotates the first throttle valve 32 from its closed position (FIG. 4B) to its open position (FIG. 5B) at a faster rate than the rotation of the second valve 34 from its closed position to its open position. The first and second drive gears further include teeth disposed only about a portion of the perimeter of the gears; although, this is not required.

During operation of the motor vehicle, airflow from the exterior of the vehicle flows through an air induction system, into the first and second intake passages 20, 22 of the throttle body 10 and towards the first and second throttle valves 32, 34. In response to a control signal transmitted from the electronic control unit (not shown), the motor 42 rotates the shaft 90 and drive gear 92 in a first direction (clockwise in FIG. 5A), and this rotational driving force is applied to the first and second throttle shafts 28, 30 via the gear arrangement 44. Specifically, the drive gear 92 engages the large gear part 96. As the large gear part rotates in a second direction (counterclockwise in FIG. 5A), the small gear part 98 drives the first drive gear 100 in the first direction at a first rate. The first throttle shaft 28 rotates in the first direction, and the first throttle valve 32 selectively rotates from its closed position to an open position to open the first intake passage 20. The first drive gear engages the connecting gear 104 which, in turn, rotates in the second direction. As the connecting gear 104 rotates, it engages the second drive gear 102 and drives the second drive gear in the first direction at a second rate which is slower than the first rate. The second throttle shaft 30 rotates in the first direction, and the second throttle valve 34 selectively rotates from its closed position to an open position to open the second intake passage 22. Therefore, the gear arrangement 44 selectively and sequentially opens the first and second throttle valves 32, 34 in the first direction at varying rates so that a respective open position of each throttle valve exhibits a predetermined value (i.e., allows a specific amount of airflow thereby) which, in turn, allows for both low and high flow rates of intake air into the throttle body 10.

As shown in FIGS. 4A and 5A, the throttle body 10 further includes a stop mechanism or gear stop assembly 120 for preventing movement of the first and second throttle valves 32, 34. At least one gear of the gear arrangement 44 engages the gear stop assembly 120 when one of the first and second throttle valves 32, 34 has moved to its respective fully opened position (i.e., its full throttle position). In the depicted embodiment, the gear stop assembly 120 includes a finger or projection 122 extending outwardly from the first drive gear 100 and a first protrusion 124 mounted to the first side wall 62 of the housing 14. The finger 122 engages the first protrusion 124 when the first throttle valve 32 is in the fully open position. It should be appreciated that the finger can extend outwardly from the second drive gear 102. A second protrusion 126 can also be mounted to the first side wall for engaging the finger 100 when the first throttle valve is in the closed position. The first and second protrusions 124, 126 are angularly spaced from each other approximately 90°, which allows the throttle valves 32, 34 to be fully opened and closed. It should also be appreciated that that the alternative manners for preventing movement of the throttle valves are also contemplated and should be considered within the scope of the present disclosure.

On the other hand, if the motor 42 rotates in the opposite second direction based on the control signal from the electronic control unit, the first and second throttle shafts 28, 30 rotate in the second direction, and the first and second throttle valves 32, 34 rotate from their open positions to their closed positions, which closes the first and second intake passages 20, 22.

It should be appreciated that idle speed control can be carried out by the drive mechanism 40 and the first and second throttle valves 32, 34. Particularly, the motor 42 is actuated based on a signal from the electronic control unit. The motor 42 drives the first and second throttle shafts 28, 30 and the opening of the first and second throttle valves 32, 34 can be finely adjusted.

As is well known, one or more biasing means or mechanisms (not shown) for biasing or urging each throttle valve 32, 34 back to its closed position can be provided. The biasing means can include at least one torsion spring disposed close to one of the gears of the gear arrangement 44. The at least one torsion spring applies a rotational energizing force to the throttle shafts 28, 30 to return the throttle valves 32, 34 to a predetermined angular position. Generally, the biasing means can be located near the throttle shafts to prevent torsion of the throttle shafts. As indicated previously, the throttle shafts 28, 30 rotate in the first direction which, in turn, rotate the throttle valves 32, 34 from their closed positions to their open positions to fully open the intake passages. This rotation is against the energizing force of the biasing means. In the normal operation, the rotation of the throttle valves is properly controlled by the single motor 42 according to signals from the electronic control unit. If the motor becomes inoperable while the throttle valves are in an open position, the throttle shafts can be quickly rotated by the energizing force of the biasing means to return the throttle valves to the closed position.

Figure 6:
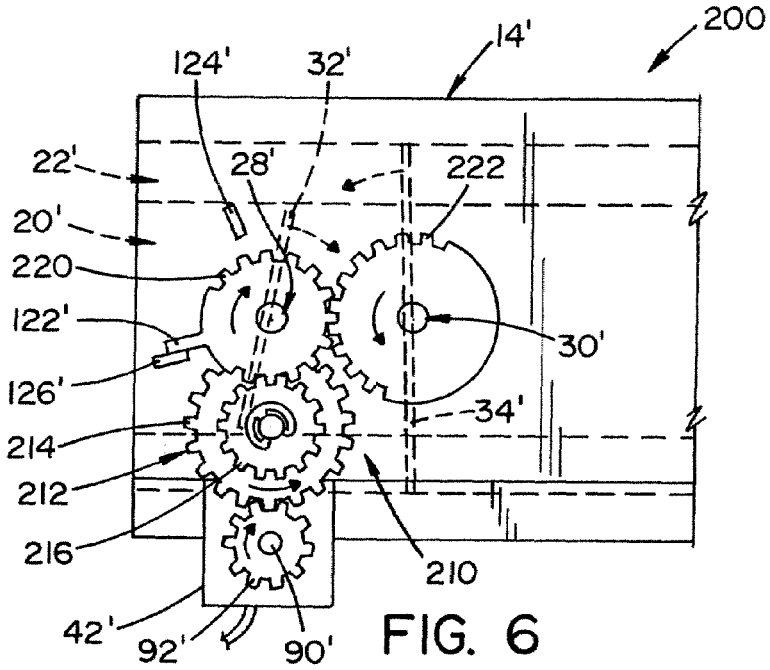
FIG. 6 is a partial side view of a throttle body including a drive means or mechanism according to another aspect of the present disclosure.
Figure 7:
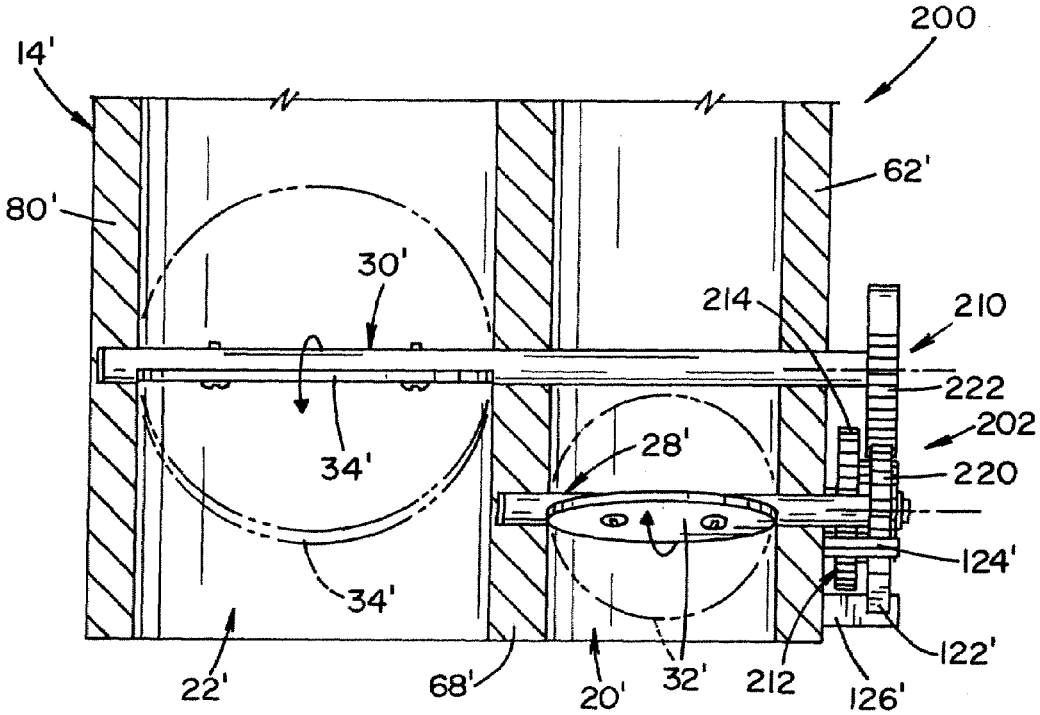
FIG. 7 is a cross-sectional view of the throttle body of FIG. 6.

With reference to FIGS. 6 and 7, a dual-bore throttle body 200, according to a second aspect of the present disclosure, used to control airflow into an internal combustion engine (not shown) of a motor vehicle is illustrated. The throttle body 200 is similar to the previous embodiment except for drive means or mechanism 202. In the embodiment of FIGS. 6 and 7, reference numerals with a single primed suffix (') refer to like components and will be explained in no more detail.

The drive mechanism 202 controls the rotation of the first and second throttle shafts 28', 30'. Again, as the first and second throttle shafts rotate, the first and second throttle valves 32', 34' likewise rotate and selectively adjust the cross-sectional areas of the first and second intake passages 20', 22' that are not obstructed by the throttle valves. The throttle shafts and throttle valves control airflow through the intake passages in order to achieve the optimal mix of air and fuel within the engine. The drive mechanism 202 includes a single motor 42' operably engaged with a gear arrangement or train 210.

The single motor 42' includes a drive shaft 90' and a drive gear 92'. The gear arrangement 210 includes a plurality of gears arranged to selectively and sequentially move the first and second throttle valves 32', 34' at varying rates. Similar to gear arrangement 44, gear arrangement 210 generally includes a deceleration gear 212 that integrally includes a large gear part 214 and a small gear part 216. The gear arrangement further includes a first drive gear 220 that is fixed to the first throttle shaft 28', and a second drive gear 222 that is fixed to the second throttle shaft 30'. The first drive gear is smaller is size than the second drive gear, which allows for rotation of the first throttle shaft 28' at a faster rate than the rate of rotation of the second throttle shaft 30'.

During operation of the motor vehicle, airflow from the exterior of the vehicle flows through an air induction system, into the first and second intake passages 20', 22' of the throttle body 200 and towards the first and second throttle valves 32', 34'. In response to a control signal transmitted from the electronic control unit (not shown), the motor is selectively actuated and rotates the drive gear 92' in a first direction (clockwise in FIG. 6). The drive gear 92' engages the deceleration gear 212. As the deceleration gear rotates in a second direction (counterclockwise in FIG. 6), the deceleration gear drives the first drive gear 220 in the first direction at a first rate. The first throttle shaft 28' rotates in the first direction, and the first throttle valve 32' rotates from its closed position to its open position to selectively open the first intake passage 20'. The first drive gear 220 engages the second drive gear 222 and drives the second drive gear in the second direction at a second rate which is slower than the first rate. The second throttle shaft 30' rotates in the second direction, and the second throttle valve 34' rotates from its closed position to its open position to selectively open the second intake passage 22'. Therefore, the gear arrangement 210 selectively rotates and opens the first throttle valve 32' in the first direction at the first rate and sequentially rotates and opens the second throttle valve 34' in the second direction at the slower second rate.

As to a further discussion of the manner of usage and operation of throttle body 200, the same should be apparent from the above description relative to throttle body 10. Accordingly, no further discussion relating to the manner of usage and operation will be provided.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. A throttle body for an internal combustion engine of an automobile, the throttle body comprising:

a housing defining a plurality of spaced apart, separated intake passages;

a plurality of throttle valves rotatably disposed in said plurality of intake passages;

a plurality of throttle shafts, each throttle shaft being adapted to support one of the plurality of throttle valves; and a drive mechanism operably connected to said plurality of throttle shafts to rotate said plurality of throttle valves, said drive mechanism including a single motor and a gear arrangement, said gear arrangement configured to drive at least two throttle shafts of said plurality of throttle shafts at varying speeds, and said gear arrangement selectively and sequentially opens at least two throttle valves of said plurality of throttle valves at varying rates, wherein one of said at least two throttle valves is located downstream from the other of said at least two throttle valves.

2. The throttle body of claim 1, wherein said gear arrangement includes a plurality of gears, said at least two throttle shafts being operably and directly connected to at least two gears of said plurality of gears.

3. The throttle body of claim 2, further comprising a stop means, at least one gear of said plurality of gears engaging said stop means when one of said throttle valves of said at least two throttle valves is in a fully opened position.

4. The throttle body of claim 1, wherein each throttle shaft of said at least two throttle shafts includes a longitudinal axis, said longitudinal axes being offset from one another.

5. The throttle body of claim 1, wherein said at least two throttle valves have differing diameters.

6. The throttle body of claim 1, wherein said at least two throttle valves have substantially equal diameters.

7. The throttle body of claim 1, wherein each throttle valve of said at least two throttle valves sequentially rotates in a first direction.

8. The throttle body of claim 1, wherein one throttle valve of said at least two throttle valves rotates in a first direction and one throttle valve of said at least two throttle valves sequentially rotates in a second direction.

9. The throttle body of claim 1, wherein said at least two throttle valves, in respective closed positions, are angularly offset from one another.

10. A throttle body for an internal combustion engine of an automobile, the throttle body comprising:

a body having a first intake passage and a separate second intake passage;

a first throttle valve moveably disposed in said first intake passage;

a second throttle valve moveably disposed in said second passage;

a first throttle shaft connected to said first throttle valve;

a second throttle shaft connected to said second throttle valve, each throttle shaft defining a longitudinal axis, said longitudinal axes of said first and second throttle shafts being parallel to each other and transverse to a longitudinal axis defined by each intake passage;

a single motor operably connected to said first and second throttle shafts for rotating said first and second shafts and said first and second throttle valves connected thereto; and a gear mechanism interconnecting said single motor and said first and second throttle shafts, said gear mechanism including a plurality of meshed gears including a first drive gear directly connected to the first throttle shaft and a second drive gear directly connected to the second throttle shaft, said gear mechanism arranged to selectively and sequentially move said first and second throttle valves, said first throttle valve moving from a first valve closed position toward a first valve open position at a faster rate than the movement of said second throttle valve from a second valve closed position toward a second valve open position to regulate and control airflow into the engine.

11. The throttle body of claim 10, further comprising a gear stop assembly for preventing movement of said first and second throttle valves past respective predetermined open positions.

12. The throttle body of claim 11, wherein said gear stop assembly includes a projection extending outwardly from one of the plurality of gears of said gear mechanism and a protrusion mounted to said body, said projection engaging said protrusion when said first throttle valve is in a fully open position.

13. The throttle body of claim 10, wherein said second throttle valve is angularly offset from said first throttle valve.

14. The throttle body of claim 10, wherein said first throttle valve has a first diameter and said second throttle valve has a second, larger diameter.

15. The throttle body of claim 10, wherein said first throttle valve and said second throttle valve have substantially equal diameters.

16. The throttle body of claim 10, wherein said first and second throttle valves sequentially rotate in a first direction.

17. The throttle body of claim 10, wherein said first throttle valve rotates in a first direction and said second throttle valve sequentially rotates in a second direction.

18. A dual bore throttle body assembly comprising:

a body having a pair of side-by-side separated intake passages extending therethrough;

a throttle valve disposed in each intake passage and being movable between a closed position and an open position, said throttle valves beings angularly offset from one another;

a separate throttle shaft connected to each throttle valve, said throttle shafts being spaced apart from one another;

a single electronic motor operably connected to said throttle shafts to rotate said throttle shafts;

a gear arrangement interconnecting said single motor and said throttle shafts, said gear arrangement configured to drive said throttle shafts at varying speeds which, in turn, selectively and sequentially moves each of said throttle valves between the closed position and the open position which in turn allows for both low and high flow rates of intake air into the throttle body; and a gear stop assembly for preventing movement of said throttle valves beyond preselected open positions.

19. The throttle body of claim 18, wherein said gear stop assembly prevents movement of said throttle valves when one of the throttle valves is in a fully open position.

20. The throttle body of claim 18, wherein said gear arrangement is configured to rotate one of the throttle valves In a first direction and sequentially rotate the other throttle valve in one of said first direction and a second direction.

* * * * *